US005555576A

United States Patent [19]

Kim

[11] Patent Number: 5,555,576

[45] Date of Patent: Sep. 17, 1996

[54] SECTIONAL FOLDING BED

[76] Inventor: Seong R. Kim, 4B-09, Koex, 159-1, Samsung-Dong, Kangnam-Ku, Seoul, Rep. of Korea

[21] Appl. No.: 386,983

[22] Filed: Jan. 17, 1995

[51] Int. Cl.[6] ..... A47C 17/72; A47C 17/64

[52] U.S. Cl. ..... 5/114; 5/116

[58] Field of Search ..... 5/117, 114, 116, 5/111, 112

[56] References Cited

U.S. PATENT DOCUMENTS

| | | | |
|---|---|---|---|
| 1,602,115 | 10/1926 | Malis | 5/114 |
| 1,787,566 | 1/1931 | Brown | 5/117 |
| 2,591,551 | 4/1952 | Kaplan | 5/117 |
| 2,611,906 | 9/1952 | Backer | 5/117 |
| 2,611,908 | 9/1952 | Siggers | 5/117 |

*Primary Examiner*—Alexander Grosz
*Attorney, Agent, or Firm*—Donald R. Comuzzi; Christopher L. Makay

[57] ABSTRACT

A sectional folding bed includes a first longitudinal member and a second longitudinal member with each longitudinal member having a first protrusion and a second protrusion at respective ends. A sheet including a first loop and a second loop is secured between said first and second longitudinal members. A first cross member that fits through the first loop of the sheet includes first and second holes that receive a respective one of the first protrusions of the first and second longitudinal members. A second cross member that fits through the second loop of the sheet includes a hole for receiving the second protrusion of the first longitudinal member and a locking member for receiving the second protrusion of the second longitudinal member.

4 Claims, 2 Drawing Sheets

SECTIONAL FOLDING BED

BACKGROUND OF THE INVENTION

1. Field of the Invention

The present invention relates to sectional folding beds and, more particularly, but not by way of limitation, to a sectional folding bed incorporating an improved locking member that facilitates easy assembly.

2. Description and Related Art

Sectional folding beds include a frame consisting of first and second longitudinal members having a sheet strung therebetween, first and second cross members, and at least two folding legs. The folding legs each include a hinge that permits their folding such that the first and second longitudinal members reside directly adjacent. Additionally, the folding legs connect to the first and second longitudinal members by hinges to permit their folding directly adjacent the first and second longitudinal members. The first and second longitudinal members each include a hinge at their center point that allows them to be folded in half to complete the break down of the sectional folding bed.

Assembly of the bed consists of unfolding the first and second longitudinal members and the folding legs. The first and second cross members are then mounted between the first and second longitudinal members to support the sheet. The ends of the sheet are each folded and stitched to form a loop that receives one of the first and second cross members. The ends of the first and second longitudinal members each include a protrusion, while the first and second cross members each include a corresponding hole for receiving one of the protrusions. Thus, after the first and second cross members are slid through a respective loop in the sheet, the protrusions are inserted into a corresponding hole to complete assembly of the sectional folding bed.

Placing the first three protrusions into a corresponding hole of the first and second members is relatively easy because there is little tension in the sheet. Unfortunately, the placement of the last protrusion into the last corresponding hole greatly tensions the sheet which makes that insertion extremely difficult. A person must be strong enough to pull the cross member having the last hole past the protrusion and then place the protrusion in the hole. That is extremely difficult and quite often cannot be performed due to the tension created in the sheet thereby rendering the sectional folding bed unusable. Accordingly, a sectional folding bed incorporating a locking member that facilitates easy assembly will significantly improve over standard sectional folding beds.

SUMMARY OF THE INVENTION

In accordance with the present invention, a sectional folding bed includes a first longitudinal member and a second longitudinal member with each longitudinal member having a first protrusion and a second protrusion at respective ends. A sheet including a first loop and a second loop is secured between said first and second longitudinal members. A first cross member that fits through the first loop of the sheet includes first and second holes that receive a respective one of the first protrusions of the first and second longitudinal members. A second cross member that fits through the second loop of the sheet includes a hole for receiving the second protrusion of the first longitudinal member and a locking member for receiving the second protrusion of the second longitudinal member.

The locking member includes a cavity having a ramp and a depression wherein the ramp facilitates the placement of the second protrusion of said second longitudinal member into the depression. The locking member fits inside the second cross member and resides within a receiving space of the second cross member to expose the cavity exterior to the second cross member. The locking member further includes a slot for receiving a wedge that secures the locking member within the second cross member.

It is, therefore, an object of the present invention to provide a cross member of a sectional folding bed with a locking member that facilitates easy assembly of the sectional folding bed.

Still other objects, features, and advantages of the present invention will become evident to those skilled in the art in light of the following.

DETAILED DESCRIPTION OF THE PREFERRED EMBODIMENT

Figure 1:
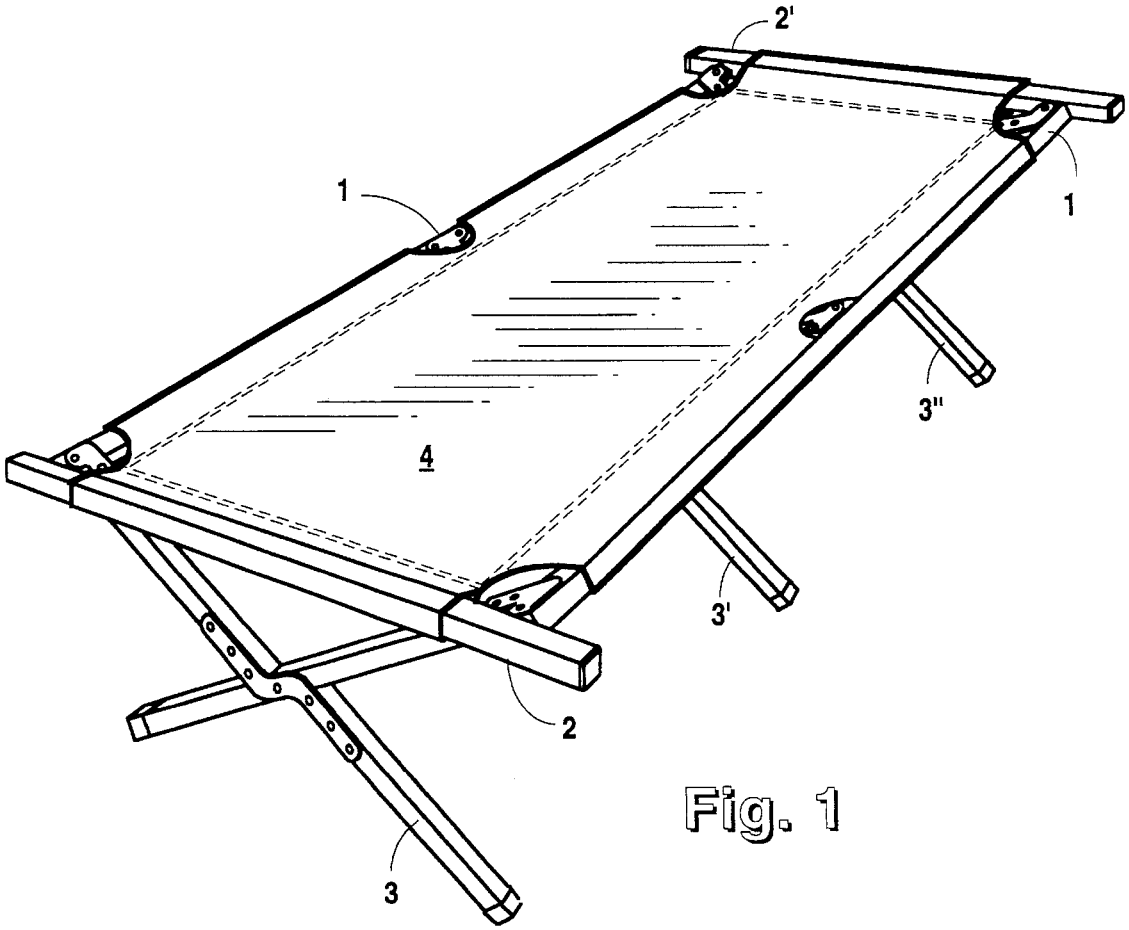
FIG. 1 is a perspective view illustrating a sectional folding bed according to the preferred embodiment.

As illustrated in FIG. 1, a folding sectional bed includes longitudinal members 1 and 1', cross members 2 and 2', legs 3, 3', and 3", and sheet 4. Leg 3 includes hinge 15 to permit the movement of leg 3 from a folded position wherein both members of leg 3 are directly adjacent to an unfolded position. Similarly, legs 3' and 3" each include a hinge that permits their movement between a folded and an unfolded position. With legs 3, 3', and 3" collapsed to their folded positions, longitudinal members 1 and 1' reside directly adjacent. Legs 3, 3', and 3" attach to longitudinal members 1 and 1', respectively, by hinges 16–18 and 16'–18'. Hinges 16–18 and 16'–18' permit the folding of legs 3, 3', and 3" to a position directly underneath longitudinal members 1 and 1'. Furthermore, hinges 17 and 17' are double hinges that permit longitudinal members 1 and 1', respectively, to be folded in half thereby reducing the storage size of the sectional folding bed.

The sectional folding bed includes sheet 4 to furnish support for a user. Sheet 4 includes loops 19 and 19' that receive longitudinal members 1 and 1', respectively, to permanently secure sheet 4 between longitudinal members 1 and 1'. Sheet 4 further includes loops 20 and 20' that receive cross members 2 and 2' to maintain tension on sheet four when cross members 2 and 2' are mounted onto longitudinal members 1 and 1'.

Figure 2:
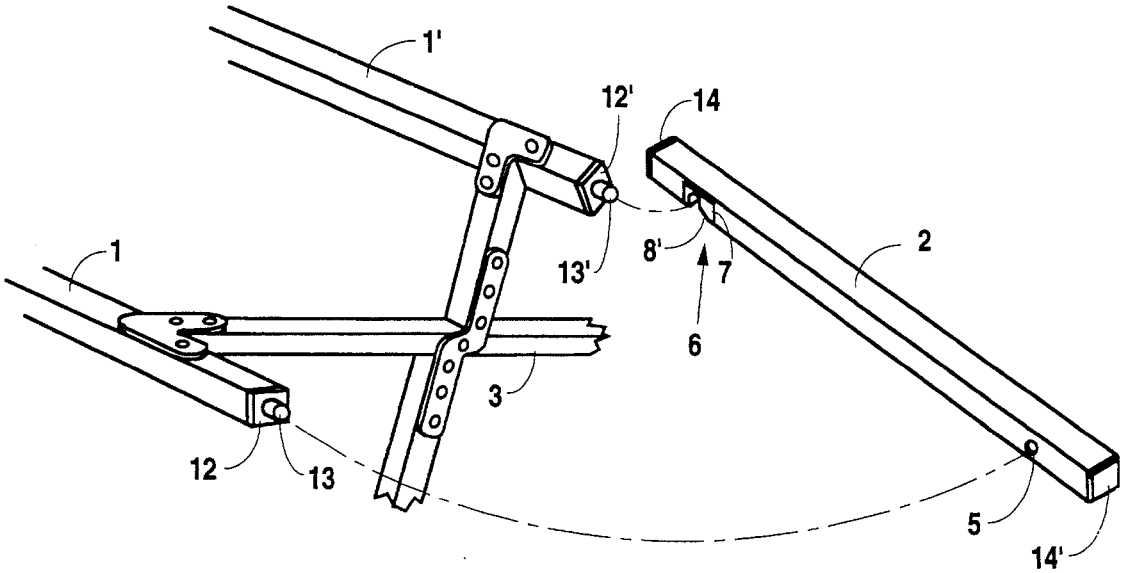
FIG. 2 is a perspective view illustrating the assembly of the sectional folding bed utilizing a locking member according to the preferred embodiment.
Figures 3A, 3B, 3C:
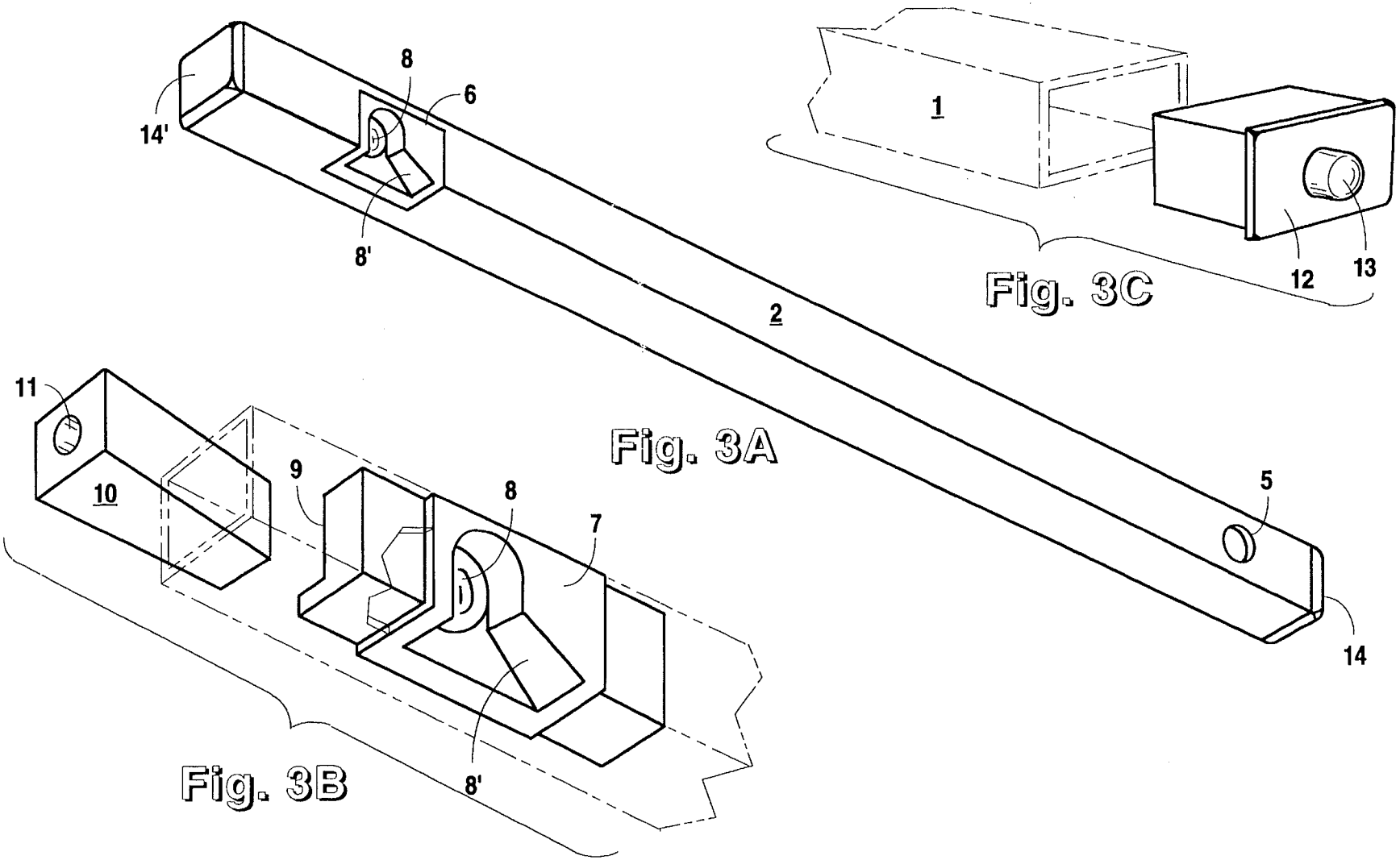
FIG. 3A is a perspective view illustrating a cross member including the locking member according to the preferred embodiment.
FIG. 3B is a partial perspective view illustrating the mounting of the locking member to the cross member according to the preferred embodiment.
FIG. 3C is a partial perspective view illustrating the mounting of a plug including a protrusion into a longitudinal member according to the preferred embodiment.

As illustrated in FIGS. 2 and 3C, longitudinal members 1 and 1' include plugs 12 and 12', respectively. Plugs 12 and 12' each include a respective protrusion 13 and 13' to facilitate the mounting of cross member 2 between longitudinal members 1 and 1'. Plugs 12 and 12' fit within a respective opening into longitudinal members 1 and 1' and are held therein by friction. The opposite ends of longitudinal members 1 and 1' are fitted with identical plugs with identical protrusions to facilitate the mounting of cross member 2' between longitudinal members 1 and 1'.

As illustrated in FIGS. 3A and B, cross member 2 includes hole 5, locking member 7, and plugs 14 and 14'. Locking member 7 includes cavity 8 having ramp 8' and depression 8". Locking member 7 further includes slot 9 that allows the securing of locking member 7 within cross member 2 using wedge 10. Locking member 7 fits inside cross member 2 and resides within receiving space 6 cut from cross member 2 to expose cavity 8 exterior to cross member 2. After the placement of locking member 7 within cross member 2 such that it resides in receiving space 6, wedge 10 is forced into slot 9 to secure locking member 7 within cross member 2. After the placement of locking member 7 within cross member 2, plugs 14 and 14' fit within a respective opening into cross member 2 and are held therein by friction.

Cross member 2' is identical to cross member 2, except it includes two holes similar to hole 5 of cross member 2 because only one locking member is required. However, although only one locking member is required, those skilled in the art will recognize that additional locking members up to four could be substituted for the holes in cross members 2 and 2'.

Referring again to FIGS. 1 and 2, after longitudinal members 1 and 1' have been unfolded, and legs 3, 3', and 3" moved to their unfolded positions, cross member 2' is inserted through loop 20'. The protrusions from the plugs in longitudinal members 1 and 1' are then inserted into a corresponding hole within cross member 2' to secure cross member 2' onto the ends Of longitudinal members 1 and 1'. Next, cross member 2 is inserted through loop 20, and protrusion 13 of plug 12 inserted into hole 5. Finally, protrusion 13' of plug 12' is inserted into cavity 8 of locking member 7 to complete the assembly of the sectional folding bed.

More particularly, cross member 2 is pulled away from longitudinal member 1' until protrusion 13' resides on ramp 8' of locking member 8. Cross member 2 is then forced downward which causes protrusion 13' to traverse ramp 8' and snap into depression 8". With protrusion 13' residing within depression 8", sheet 4 assumes a properly tensioned position. Locking member 7, therefore, facilitates easy assembly of the sectional folding bed because ramp 8' exerts a lever-type force against protrusion 13' that significantly decreases the amount of strength required by a user to guide protrusion 13' into depression 8".

Although the present invention has been described in terms the foregoing embodiment, such description has been for exemplary purposes only and, as will be apparent to one of ordinary skill in the art, many alternatives, equivalents, and variations of varying degrees will fall within the scope of the present invention. That scope, accordingly, is not to be limited in any respect by the foregoing description, rather, it is defined only by the claims that follow.

I claim:

1. A sectional folding bed, comprising:

a first longitudinal member including a first protrusion and a second protrusion at its respective ends;

a second longitudinal member including a first protrusion and a second protrusion at its respective ends;

a sheet secured between said first and second longitudinal members, said sheet including a first loop and a second loop;

a first cross member placeable through said first loop, said first cross member including first and second holes that receive a respective one of said first protrusions of said first and second longitudinal members;

a second cross member placeable through said second loop, said second cross member including a hole for receiving said second protrusion of said first longitudinal member and a locking member for receiving said second protrusion of said second longitudinal member, said locking member including a cavity having a ramp and a depression wherein said ramp facilitates the placement of said second protrusion of said second longitudinal member into said depression.

2. The sectional folding bed according to claim 1 wherein said locking member fits inside said second cross member and resides within a receiving space of said second cross member in a position with said cavity of said locking member facing exterior to said second member.

3. The sectional folding bed according to claim 2 wherein said locking member includes a slot for receiving a wedge that secures said locking member within said second cross member.

4. The sectional folding bed according to claim 1 wherein each of said first and second longitudinal members includes legs attached thereto.

* * * * *